United States Patent [19]

Wilson

[11] Patent Number: 4,658,258

[45] Date of Patent: Apr. 14, 1987

[54] TAPERD HORN ANTENNA WITH ANNULAR CHOKE CHANNEL

[75] Inventor: Robert M. Wilson, Hamilton Square, N.J.

[73] Assignee: RCA Corporation, Princeton, N.J.

[21] Appl. No.: 554,086

[22] Filed: Nov. 21, 1983

[51] Int. Cl.[4] ..... H01Q 13/02

[52] U.S. Cl. ..... 343/786; 343/840

[58] Field of Search ..... 343/783, 786, 840

[56] References Cited

FOREIGN PATENT DOCUMENTS 0079533 11/1982 European Pat. Off. .
3144319 5/1983 Fed. Rep. of Germany .
3146273 5/1983 Fed. Rep. of Germany .
1008954 3/1952 France ..... 343/786
1219872 1/1971 United Kingdom ..... 343/786

*Primary Examiner*—Eli Lieberman
*Attorney, Agent, or Firm*—Joseph S. Tripoli; Robert L. Troike

[57] ABSTRACT

A low cost tapered horn with desirable equal E and H plane pattern beamwidths is achieved with one or more annular channels in the tapered wave translation surfaces of the horn. These channels extend concentric and parallel with the axis of symmetry of the horn to permit the horn including the channels capable of being formed using molding techniques.

7 Claims, 7 Drawing Figures

TAPERD HORN ANTENNA WITH ANNULAR CHOKE CHANNEL

This invention relates to antennas and more particularly to a low cost tapered horn antenna for use as a primary feed for a parabolic antenna system.

Much has been written in the literature about dual-mode horns, corrugated horns, and other special horn designs describing their ability to achieve radiation patterns having rotational symmetry and low side lobe levels. However, these designs are complicated and costly to manufacture. For circular polarization applications it is desirable that the width of the main beam's E and H plane patterns be equal in order to achieve good axial ratio characteristics over the feed-to-reflector illumination angle. This symmetrical illumination of a paraboloid reflector achieved by a horn with equal E and H plane beamwidths will also result in good secondary pattern cross-polarization characteristics.

Kay in U.S. Pat. No. 3,216,018 or 3,274,603 describes a wide angle horn where in FIG. 3 of U.S. Pat. No. 3,216,018, for example, there is illustrated radiation suppression means added to improve the E plane radiation pattern. In FIG. 3 of U.S. Pat. No. 3,216,018 there is illustrated a pair of rod shaped elements 36 and 37 which produce an illumination such that the elements reduce the excessive E plane radiation to a level commensurate with the H plane radiation. The rod shaped elements 36 and 37 extend perpendicular to the inside conical surface of the conical horn. In FIGS. 5 and 6 of the U.S. Pat. No. 3,216,018 reference the rods are replaced by annular members. Here the rods are replaced by the annular member 38 which also extends perpendicular to the inside conical surface of the horn. FIGS. 7, 8 and 9 illustrate that the same effect can be achieved by grooves that are formed in the walls of the horn that extend generally perpendicular to the surface of the horn and at depths between a quarter and a half a wavelength long at the operating frequency. This type of feed horn with the perpendicular angular grooves has been extensively utilized as a feed horn in satellite communications systems. In particular they have been found of use in feeds for receiving television broadcast signals from satellites. This type of feed is expensive in that it requires costly machining techniques to form the perpendicular grooves in the flared cavity walls. It is desirable to design a feed which can be fabricated by using low cost molding or die casting techniques. This is particularly true for home satellite receiving antenna systems where cost is a very important factor. Molding and die casting techniques are not readily adaptable to horns with perpendicularly grooved flared walls. A new, alternative type of feed horn which can be manufactured economically is therefore required for low cost antenna systems. This new feed horn design, in addition to having equal E and H plane beamwidths and low side lobe levels, should be capable of being fabricated so that the angular width of its main lobe can be controlled by selecting the proper horn dimensions.

In accordance with one embodiment of the present invention a unique horn antenna is provided wherein the tapered metallic conical surface has one or more annular channels therein which are concentric and extend parallel with the horn's axis of symmetry.

Figure 1:
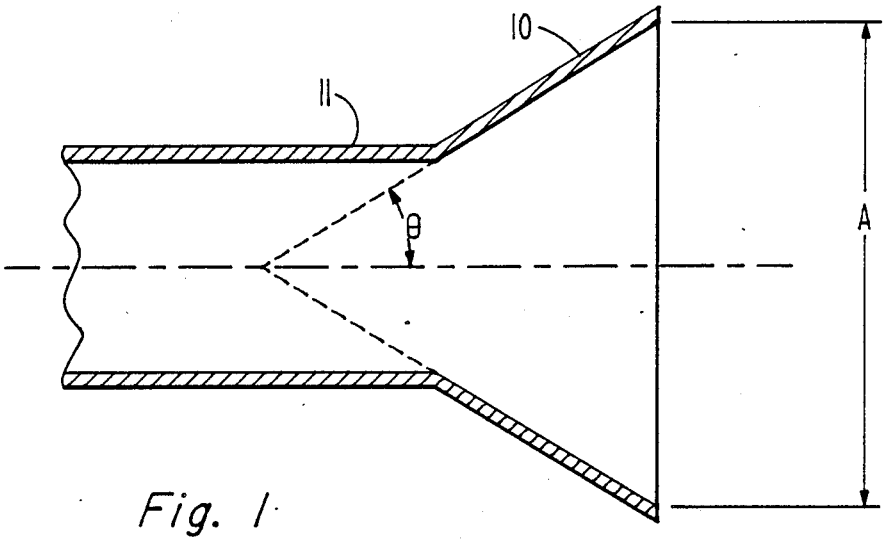
Fig. 1 PRIOR ART
FIG. 1 illustrates the cross-sectional profile of a conventional conical horn according to the prior art.

Referring to FIG. 1 there is illustrated a small conical horn feed 10 fed by section 11 of circular waveguide. This type of horn is commonly used as a primary feed to illuminate parabolic and other shapes of reflective surfaces. Its main advantage is that it is simple to design and economical to produce. For very small aperture A diameters, its E and H plane beamwidths tend to be almost equal. For example, for a $\theta$ equal to 20° and aperture diameter equal to 0.92 inches, the E and H plane patterns (at 12.45 GHz) both have a −10 db beamwidth of approximately 113°. However, the back lobe is quite high and on the order of −15 db. As the conical horn aperture is made larger the E and H plane beamwidth both decrease, but not equally. As the aperture diameter becomes increasingly greater, the E and H plane beamwidths become increasingly less equal with the H plane beamwidth normally being wider. The exact beamwidth (and pattern shapes) are also a function of flare angle. In any case, it is difficult to achieve equal (or nearly equal) E and H plane patterns from simple conical horns if −10 db beamwidths of less than approximately 100° are desired.

Figure 3:
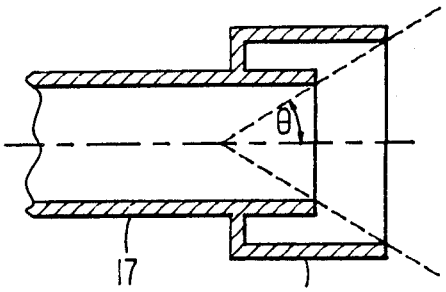
FIGS. 3, 4 and 5 illustrate the cross-sectional profile of conical horns with one, two and four channels respectively in accordance with other embodiments of the present invention.

Kay in U.S. Pat. No. 3,216,018 teaches a way to improve the E plane radiation by the addition of elements perpendicular to the inside conical surface and aligned in the E plane as indicated in Kay's FIGS. 3 and 4. The elements described in Kay's FIGS. 3 and 4 can be replaced as shown in Kay's FIGS. 5 and 6 with annular rings or in FIGS. 7, 8 and 9 of Kay with annular grooves that extend perpendicular to the conical surface. Although these perpendicular members, rings or grooves accomplish equalization of the E and H plane patterns with beamwidths of less than 100° this type of structure is costly to manufacture as compared to a structure which is easily adaptable to molding and/or casting techniques.

Figure 2:
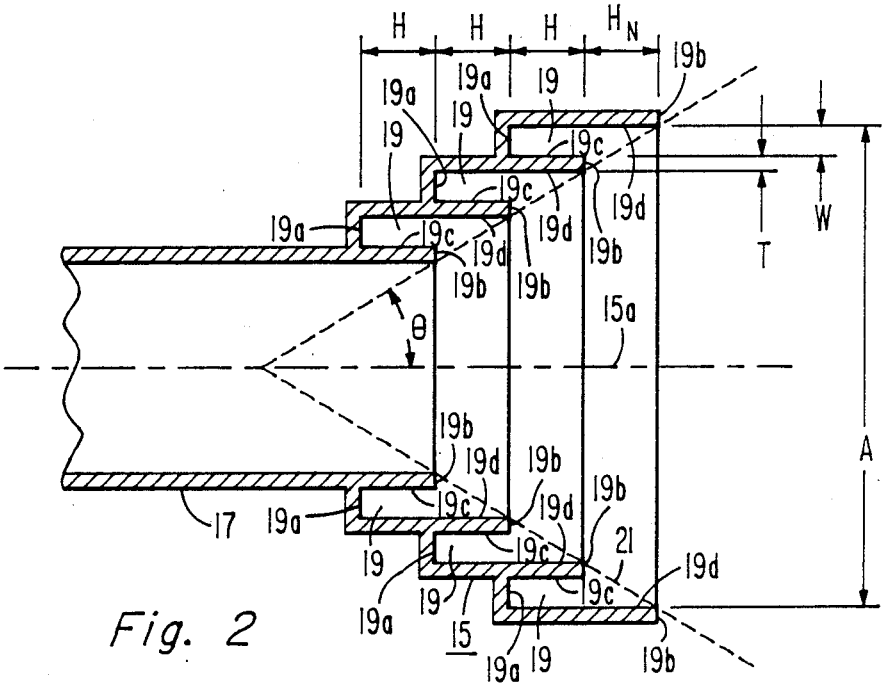
FIG. 2 illustrates the cross-sectional profile of a conical horn with choke channels in accordance with one embodiment of the present invention.

Applicant's invention results from a discovery that the E and H plane patterns can be equalized by channels that extend from the inside conical surface of the horn and in a direction that is parallel to the horn's axis of symmetry and need not be in the E plane perpendicular to the conical surface as in Kay. FIG. 2 illustrates the basic construction features of one embodiment of the present invention. Basically, the metallic horn 15 is a conical horn of the same wave translation taper as shown by the dotted line 21 in FIG. 2 fed by section 17 of circular waveguide. However, the smooth walls of the conventional conical horn are replaced with concentric narrow annular channels 19 that operate as RF choke rings. The wave translation surfaces of the horn 15 are at the free ends **19*b* of the channels 19 in FIG. 2. The channels 19 extend parallel to the horn's axis of symmetry 15*a* from the translation surfaces at ends 19*b* (along the dotted line 21) to bottom conductive walls 19*a*. Note that all annular channels 19 are concentric and parallel with the horn's axis of symmetry 15*a*. The inner side wall 19c of each channel 19 is of a depth H, from the translation surface at end 19b to the bottom wall 19a, of about (±20%) one quarter operating frequency wavelength ($\lambda/4\pm20\%$). The outer side wall 19d formed by each concentric outer ring extends a depth 2H from the translation surface at end 19b to the bottom wall 19a. In this way the depth H of the channel 19 varies across the width W from about one quarter to one half an operating frequency wavelength. The bottom wall 19a of width W of each successive channel starts at about the middle of the outer side wall 19d of the preceding smaller diameter channel. In this fashion the dotted line 21 which connects the edges of the free ends 19b** of each wall lies on a straight line which forms the flare angle $\theta$ of the horn.

$$\text{angle } \theta = \tan^{-1}[(W+T)/H],$$

where W is the channel width, T is the channel wall thickness and H is the channel depth as shown in FIG. 2.

A typical model (one of many which was fabricated and tested at 12.45±0.25 GHz) has the following dimensions:

channel depth H=0.242 inch (6.15 mm, 0.255 $\lambda_0$)
channel width W=0.130 inch (3.3 mm, 0.137 $\lambda_0$)
wall thickness T=0.030 inch (0.76 mm, 0.032 $\lambda_0$)
horn aperture A=1.65 inch (41.91 mm, 1.74 $\lambda_0$)
horn flare angle $\theta$=34°
$\lambda_0$=free space wavelength at center operating frequency
mm=millimeters At 12.45 GHz (gigahertz), a standard horn without chokes with a flare angle of 34° and an aperture diameter of 1.65 inches (41.91 mm) has E and H plane −10 dB beamwidths of approximately 67° and 76°, respectively. The maximum side lobe (E-plane) and back lobe levels are approximately −18 to −20 dB.

The conical choke horn design illustrated in FIG. 2 (with the dimensions given above) provides the following −10 dB beamwidths:

| FREQUENCY (GHz) | BEAMWIDTH E | BEAMWIDTH H |
|---|---|---|
| 12.20 | 71° | 71° |
| 12.45 | 72° | 72° |
| 12.70 | 73.5° | 73.5° |

For any given frequency between 12.2 and 12.7 GHz, the shape of the E-plane and H-plane patterns remain identical—down to approximately the −15 dB level. This high degree of pattern symmetry will produce very good cross-polarization characteristics when this horn is used to illuminate a symmetrical paraboloid. If this horn is used to radiate a circularly-polarized wave, the axial ratio should be extremely good over a beamwidth of approximately 100°.

The conical choke horn design illustrated in FIG. 2 incorporates three concentric channels or RF choke sections. The dimensions H, W, and T determine the flare angle $\theta$ and the aperture diameter A. H is nominally fixed for the example at 0.25 free space wavelengths at the low end of the operating frequency.

Figure 4:
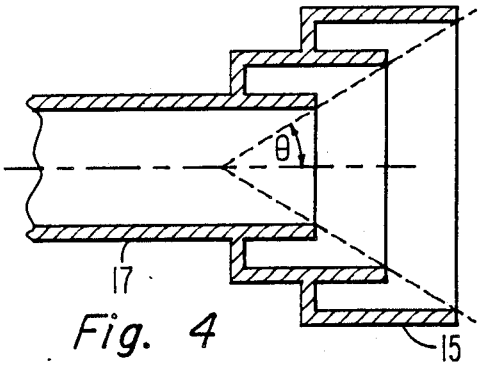
Figure 5:
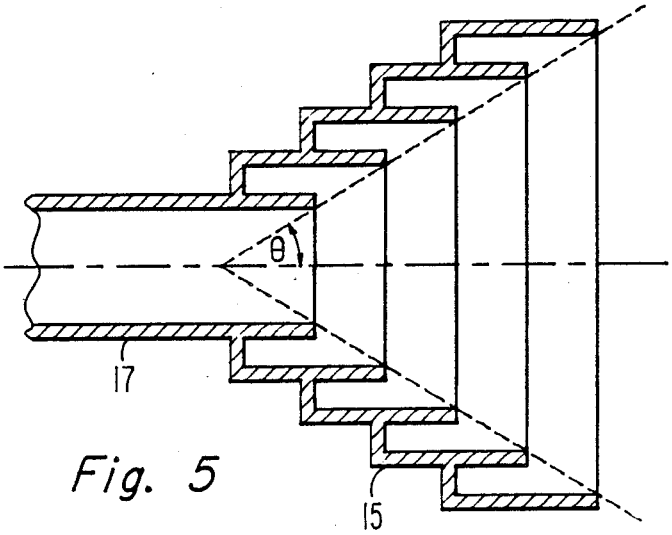
Figure 6:
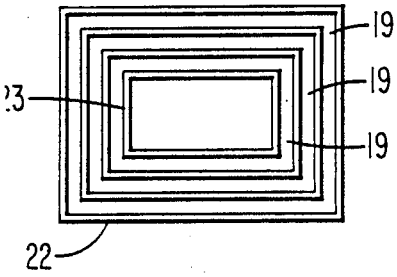
FIG. 6 is an end view of a pyramidal horn with channels therein.

In the example already described (i.e., frequency=12.45 GHz, $\theta$=34°, A=1.65 inches (41.91 mm)), the −10 dB beamwidth is 72°. If a wider or narrower beamwidth is desired, the aperture diameter must be made smaller or larger, respectively. This can be accomplished, within limits, by changing dimension W or T. However, best results seem to be achieved when the channel width W is between approximately 0.05 and 0.20 free space wavelengths at the center operating frequency of the radiator. The channel wall thickness T should remain reasonably thin—approximately 0.03 operating frequency wavelengths being a practical thickness for most designs. Within these dimensional limits, a three-channel (three RF choke) section design can vary between approximately $\theta$=18° and A=1.2 wavelengths to approximately $\theta$=36° and A=2.18 wavelengths. However, this tapered horn invention can also be constructed with one or more channels or RF choke sections, as illustrated in FIGS. 4, 5, and 6. E and H plane beamwidths remain equal, as seen from measured data tabulated below.

| NO. OF CHANNELS | CHANNEL WIDTH (W) | APERTURE DIAMETER (A) | FLARE ANGLE $\theta$ | −10 db BEAMWIDTH E | −10 db BEAMWIDTH H | MAXIMUM BACK/SIDE LOBES |
|---|---|---|---|---|---|---|
| 1 | 3.18 mm | 25.4 mm | 33.2° | 109 | 109 | −18 |
| 2 | 1.27 mm | 27.94 mm | 18.6° | 102 | 102 | −20 |
| 3 | 3.3 mm | 41.91 mm | 34.0° | 72 | 72 | −28 |
| 3 | 3.81 mm | 44.96 mm | 37.2° | 68 | 68 | −29 |
| 4 | 3.3 mm | 50.03 mm | 34.0° | 64 | 64 | −28 |

Experiments have shown that "fine tuning" control can be exerted over the beamwidths by adjusting the length of the outer wall designated $H_N$ in FIG. 2. Making $H_N$ less than $\frac{1}{4}\lambda_0$ (free space wavelengths) causes the H-plane beamwidth to be slightly wider than the E-plane beamwidth. Making $H_N$ greater than $\frac{1}{4}\lambda_0$ causes the H-plane beamwidth to be slightly narrower than the E-plane beamwidth. When $H_N$ is $\frac{1}{4}\lambda_0$ the E and H plane beamwidths are equal or nearly equal.

The horn may also be a pyramidal horn as shown by end view in FIG. 6. In this case the pyramidal horn 22 is fed by rectangular waveguide 23. A three channel pyramidal horn configuration would have the same cross sectional profile as the conical horn of FIG. 2. The same channel depth, wall-thickness and channel width would apply.

Figure 7:
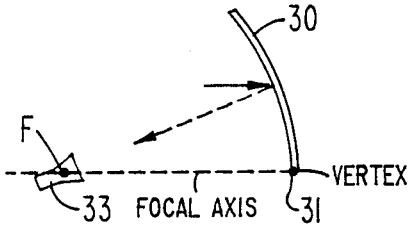
FIG. 7 is an elevation sketch of an offset feed antenna system using a horn with choke channels as described in the present invention in connection with FIG. 2.

This horn is particularly suitable for an offset feed antenna system where the reflector 30 is a section of a paraboloid of revolution where one edge 31 crosses near the vertex as illustrated in FIG. 7. The tapered feed horn 33 as described above in connection with FIG. 2 for example is located at a focus point F of the reflector 30. The feed horn 33 is tilted at an angle relative to the focal axis of the reflector to optimize the illumination of the reflector 30 to achieve maximum RF coupling of signals parallel to the focal axis. The feed horn for an offset reflector requires low side and low back lobe levels and a rotational symmetric main beam with a typical −10 dB beamwidth being approximately 72°. The feed horn 33 for example may be identical to that shown in FIG. 2 and may have the dimensions given with reference thereto.

The above described flared horn has channels 19 that extend parallel to the axis of the horn itself. This means that when the halves of the mold are pulled away in the direction of the horn's symmetrical axis there is no interference. In designs where the grooves, projections, etc., are perpendicular or otherwise at an angle with respect to the symmetrical axis of the horn, such as in the cited Kay patents, fabrication by low cost molding or die casting techniques is impossible because the finished part can not be removed from the mold. Designs of this type must be fabricated by expensive machining techniques. The present invention, due to its in-line coaxial channel construction, can be easily fabricated by simple, economical molding or die casting techniques. For low cost antenna systems, such as the type required for home satellite TV receiving terminals the present invention fulfills a need for a high performance, low cost feed horn to illuminate either a symmetrical or an off-set parabolic or other curved reflector aperture.

Applicant's horn could be molded from plastic material with the inner surface including the channels metalized by any one of a number of standard metalizing techniques to form a conductive inner surface.

I claim:

1. A microwave antenna providing substantially equal E and H plane pattern beam widths when operating over a given range of microwave frequencies comprising in combination:

a flared horn having metallic tapered wave translation surfaces, and a metallic surfaced annular channel in and extending from said tapered wave translation surfaces to a terminating conductive short for modifying the boundary conditions for waves emanating from said horn, said annular channel extends concentric and parallel with the axis of symmetry of said horn with the side walls of said annular channel being of unequal length and parallel and said side walls overlapping each other from said terminating short over a distance of one quarter wavelength at one of said microwave frequencies.

2. The combination of claim 1 wherein the depth of one of the side walls of said annular channel from said translation surfaces to said terminating short is a quarter wavelength at one of said microwave frequencies and the depth of the side wall opposite said one side wall from said translation surfaces to said terminating short is a half wavelength at said one of said microwave frequencies.

3. A microwave antenna providing substantially equal E and H plane pattern beam widths when operating over a given range of microwave frequencies comprising in combination:

a flared horn having metallic tapered wave translation surfaces, and a plurality of metallic surfaced annular channels in and extending from said tapered wave translation surfaces to a terminating conductive short for modifying the boundary conditions for waves emanating from said horn, each of said annular channels extending concentric and parallel with the axis of symmetry of said horn with the side walls of each of said annular channels being of unequal length and parallel and said side walls overlapping each other from said terminating short over a distance of one quarter wavelength at one of said microwave frequencies.

4. The combination of claim 3 wherein the depth of one of the side walls of each of said annular channels from said translation surfaces to said terminating short is a quarter wavelength at one of said microwave frequencies and the depth of the side wall opposite said one side wall from said translation surfaces to said terminating short is a half wavelength at said one of said microwave freqencies.

5. The combination of claim 4 wherein the inner side wall of a given channel extends about one quarter wavelength at the one of said microwave frequencies from the translation surfaces and the outer side wall of said given channel extends about twice the length of said inner side wall and the channels are adjacent each other such that the bottom wall of one channel is at about the middle of the outer side wall of the smaller diameter channel and wherein the free edges of the side walls form said tapered surface and the free edges of said smaller diameter channels are progressively closer to one narrower end of said horn.

6. The combination of claim 1 wherein said horn is molded from plastic material and the inner surfaces and channels are metalized.

7. An offset feed antenna system providing substantially equal E and H plane pattern beam widths when operating over a given range of microwave frequencies comprising in combination:

a reflector having an illumination aperture and a focal point, said reflector being a section of a paraboloid of revolution where the vertex is near an edge of the reflector;

a flared horn having tapered metallic translation surfaces, said horn being spaced from said reflector and so disposed that said focal point is within said horn, said horn being oriented to optimize illumination of said reflector; and one or more annular metallic surface channels in and extending from said tapered wave translation surfaces to a terminating conductive short for modifying the boundary condition for waves emanating from said horn;

said one or more annular channels extending concentric and parallel with the axis of symmetry of said horn with the side walls of each of the annular channels being of unequal length and parallel and said side walls of each channel overlapping each other from said terminating short over a distance of one quarter wavelength at one of said microwave frequencies.

* * * * *